US005579590A

United States Patent [19]

Seidl et al.

[11] Patent Number: 5,579,590

[45] Date of Patent: Dec. 3, 1996

[54] APPARATUS FOR IN-LINE PROCESSING OF A HEATED AND REACTING CONTINUOUS SHEET OF MATERIAL

[75] Inventors: Paul G. Seidl, De Pere; Steve J. Zagar, Green Bay, both of Wis.

[73] Assignee: W. R. Grace & Co.-Conn., New York, N.Y.

[21] Appl. No.: 504,817

[22] Filed: Jul. 20, 1995

Related U.S. Application Data

[62] Division of Ser. No. 368,469, Jan. 4, 1995.

[51] Int. Cl.[6] ..... F26B 21/06

[52] U.S. Cl. ..... 34/559; 34/636

[58] Field of Search ..... 34/540, 552, 554, 34/559, 629, 635, 636, 640, 643, 652

[56] References Cited

U.S. PATENT DOCUMENTS

| | | | |
|---|---|---|---|
| 3,957,187 | 5/1976 | Puigrodon | 226/7 |
| 4,137,648 | 2/1979 | Rhodes | 34/86 |
| 4,606,137 | 8/1986 | Whipple | 34/156 |
| 4,837,902 | 6/1989 | Dischler | 26/1 |
| 5,038,495 | 8/1991 | Jacobs et al. | 34/62 |
| 5,333,395 | 8/1994 | Bulcsu | 34/79 |

*Primary Examiner*—Henry A. Bennett
*Assistant Examiner*—Dinnatia Doster
*Attorney, Agent, or Firm*—Craig K. Leon; William L. Baker

[57] ABSTRACT

A drying apparatus for a strip of material or web, including a conditioning zone immediately following but fully integrated with the dryer, to lower the bulk temperature of web. The web of material can be introduced to conditioned air which is substantially free of contaminants being evolved from the coating on the web. The temperature of the conditioned air is low enough to absorb heat from the web, effectively lowering the solvent evaporation rate, and can be controlled such that it is greater than the dew point of the contaminants being evolved from the web, thereby mitigating condensation that normally forms and visible vapors that form outside of the dryer enclosure. Pressure control is provided in the conditioning zone so that solvent vapors will not escape and so that ambient make-up air can be regulated as required. Gas seal between the conditioning zone and the dryer prevents hot, solvent vapor laden air from the dryer from escaping into the conditioning zone.

8 Claims, 4 Drawing Sheets

APPARATUS FOR IN-LINE PROCESSING OF A HEATED AND REACTING CONTINUOUS SHEET OF MATERIAL

This application is a divisional of application Ser. No. 08/368,469 filed Jan. 4, 1995 (pending).

BACKGROUND OF THE INVENTION

The present invention relates to web supporting and drying apparatus. In drying a moving web of material, such as paper, film or other sheet material, it is often desirable that the web be contactlessly supported during the drying operation, in order to avoid damage to the web itself or to any ink or coating on the web surface. A conventional arrangement for contactlessly supporting and drying a moving web includes upper and lower sets of air bars extending along a substantially horizontal stretch of the web. Heated air issuing from the air bars floatingly supports the web and expedites web drying. The air bar array is typically inside a dryer housing which can be maintained at a slightly subatmospheric pressure by an exhaust blower that draws off the volatiles emanating from the web as a result of the drying of the ink thereon, for example.

One example of such a dryer can be found in U.S. Pat. No. 5,112,220, the disclosure of which is hereby incorporated by reference. That patent discloses an air flotation dryer with a built-in afterburner, in which a plurality of air bars are positioned above and below the traveling web for the contactless drying of the coating on the web. In particular, the air bars are in air-receiving communication with an elaborate header system, and blow air towards the web so as to support and dry the web as it travels through the dryer enclosure.

Similarly, U.S. Patent No.5,333,395 discloses a drying apparatus for traveling webs which includes a cooling tunnel directly connected with the dryer, a combustion chamber for combusting solvent which becomes volatile during drying of the web, heat exchangers, etc.

U.S. Pat. No. 5,038,495 discloses a cooling device for cooling a web of material exiting a dryer. The cooling device comprises a substantially closed housing with an inlet and an outlet slit for the web of material. The housing includes a feed aperture at the outlet slit side for feeding outside air into the housing, and a discharge aperture at the inlet slit side for discharging air from the housing into the dryer. Air is fed through the housing counterflow to the direction of web travel. A series of nozzles bring the infed air into contact with the web of material.

Once the traveling web exits such dryers, it is often brought into partial wrapping engagement around a rotating roller or "chill roll" so that the web can have substantial intimate contact with the cylindrical surface of the roller for heat transfer purposes to rapidly cool the web. A problem that has persisted in connection with such processes is the tendency for a film of air to intrude between the web and the cylindrical surface of the roller, thereby inhibiting effective contact (and thus heat transfer) between them. It is known that a relatively thin "boundary layer" of air is picked up by the moving surfaces of the web and the roller and that some of this air becomes trapped in the wedge-shaped space where the web approaches the roller surface. Unless the web is under a relatively high lengthwise tension, or is moving lengthwise at a relatively low speed, the trapped air enters between the roller and the portion of the web that curves around it, forming a film between the roll and the curved web portion. It will be evident that where a web is to be heated or cooled by a roller around which it is partially wrapped, an insulating film of air between the web and the roller will materially reduce the efficiency of the heat transfer. In addition, where the prior drying operation is drying ink or some other coating that has been applied on the web, the air film that is carried with the moving web may result in solvent condensing on the chill roll surface. The result can be condensate marking, streaking, spotting and/or smudging of the printed web. At higher press speeds (dependent upon web tension and chill roll diameter), the accumulation (thickness) of the condensate film increases and may transfer to the printed webs thereby affecting quality and salability of the finished product. The accumulation and thickness of the condensate is associated with the air gap developed between the web and the chill roll surface, and results in the phenomenon of "web lift-off," a clearance gap between the web proper and the surface of the roll.

It therefore would be desirable to lower the bulk temperature of the web in order to decrease the heat load of the cooling or chill rolls. Lowered web bulk temperature also would decrease the evaporation rate of the solvent mixture coating the web, thereby reducing the visible vapors evolving from the web. Condensation that normally occurs at the dryer exit and on the cooling rolls could be controlled to a minimum, and the product quality of the web could be improved in view of the absence of excessive moisture loss from the web. Excessive moisture loss can cause deleterious curling or wariness of the web.

SUMMARY OF THE INVENTION

The problems of the prior art have been overcome by the present invention, which provides a conditioning zone immediately following but fully integrated with a heat-up dryer system, to lower the bulk temperature of the web. More specifically, the web of material is introduced to conditioned air which is substantially free of contaminants being evolved from the coating on the web. The temperature of the conditioned air can be low enough to absorb heat from the web, effectively lowering the solvent evaporation rate, and can be controlled such that it is greater than the dew point of the contaminants being evolved from the web, thereby mitigating condensation that normally forms and visible vapors that form outside of the dryer enclosure. Pressure control is provided in the conditioning zone so that solvent vapors will not escape and so that ambient make-up air can be regulated as required. Gas seal between the conditioning zone and the dryer prevents hot, solvent vapor laden air from the dryer from escaping into the conditioning zone.

DETAILED DESCRIPTION OF THE INVENTION

Figure 1:
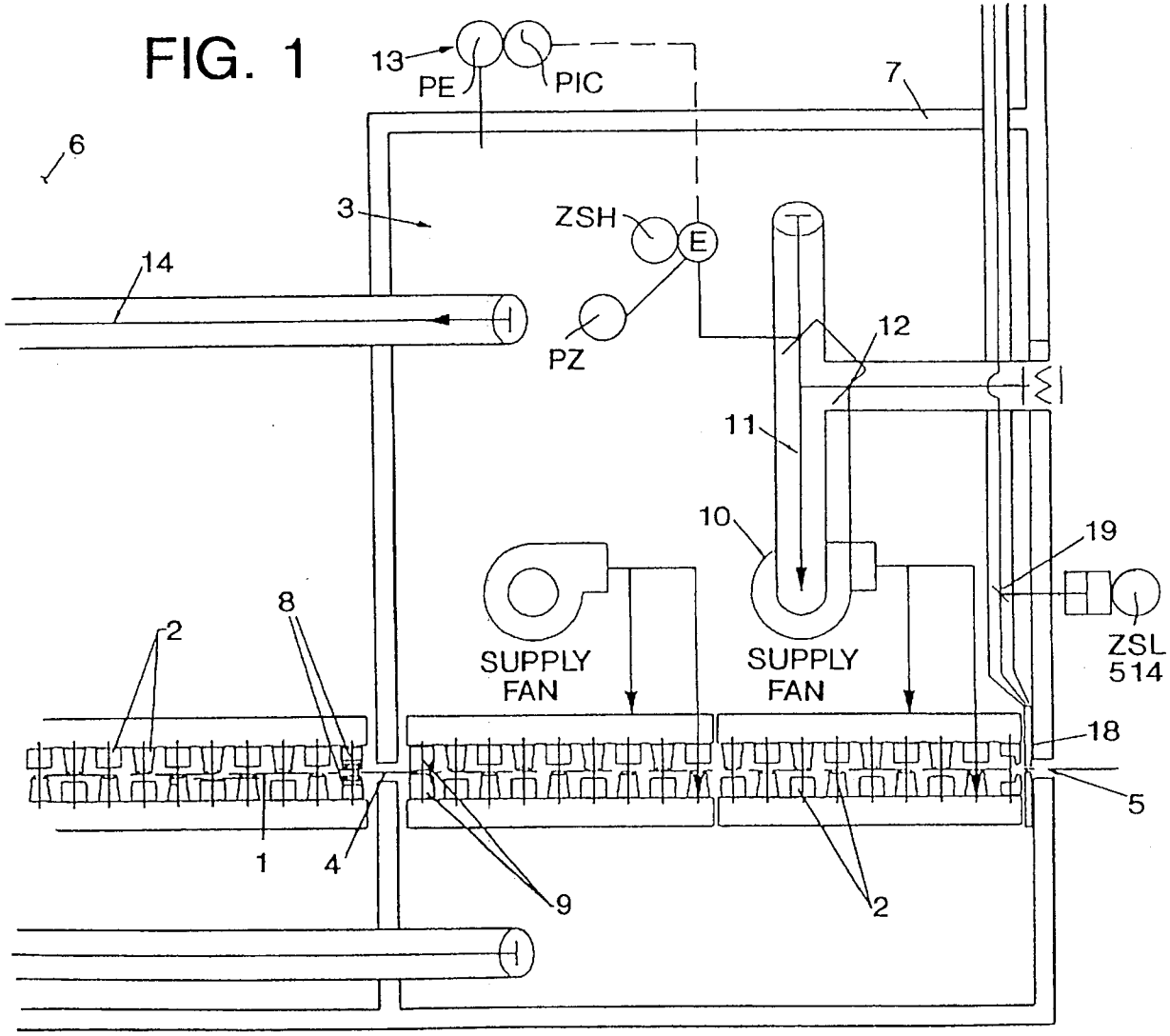
FIG. 1 is a schematic view of a conditioning zone for a dryer in accordance with one embodiment of the present invention.

Turning now to FIG. 1, a dryer enclosure 6 is partially shown having a conditioning zone 3 in accordance with the present invention. A continuous strip of material such as a web 1, supported by a series of air jet nozzles 2 enters the conditioning zone enclosure 3 via a conditioning zone enclosure opening 4. For maximum heat transfer, the jet nozzles 2 preferably include Coanda-type flotation nozzles such as the HI-FLOAT® air bar commercially available from W. R. Grace & Co. Conn, and direct impingement nozzles such as hole bars. Preferably each direct impingement nozzle is positioned opposite a Coanda-type air flotation nozzle. The web 1 is supported in the zone 3 by a series of additional air jet nozzles 2, again preferably a combination of Coanda-type air bars and direct impingement nozzles oppositely opposed, and finally exits the conditioning zone 3 and dryer enclosure 6 via opening 5.

Figure 3:
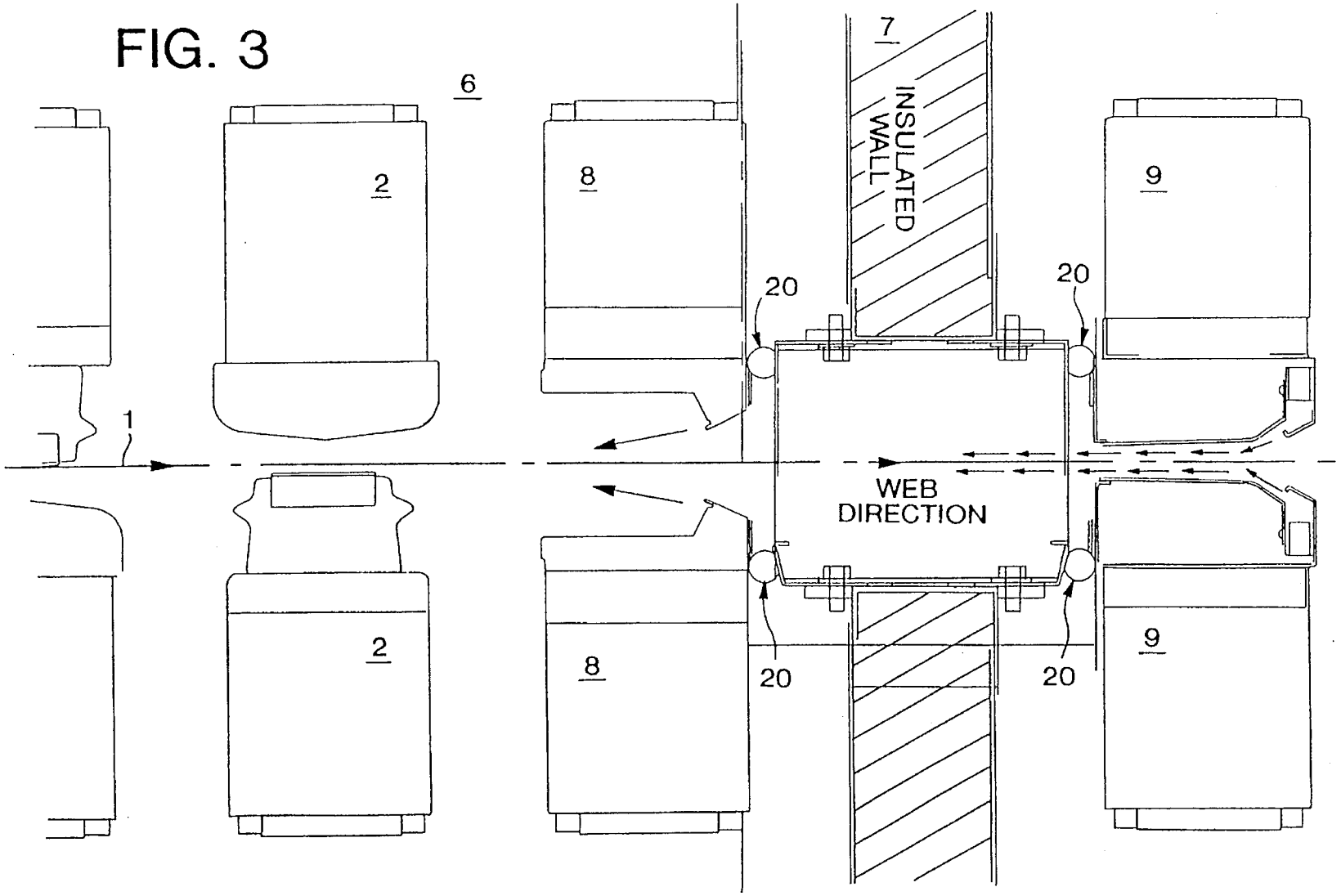
FIG. 3 is an enlarged view showing the gas seal nozzles at the junction of the dryer and the conditioning zone in accordance with the present invention.

The dryer enclosure 6 heats the strip of material 1, evaporates solvent material from the strip 1 and captures and contains the solvent vapors within the dryer atmosphere. Preferably the conditioning zone enclosure 3 is contained and fully integrated within the dryer enclosure 6, and is maintained gas tight and thermally insulated from the dryer enclosure 6 via an insulated wall 7. A pair of opposed gas seal nozzles 8 and 9 (best seen in FIG. 3) are positioned on both sides of the entering end opening 4 in the insulated wall 7 of the conditioning zone 3. Although any type of air nozzle that can effectively direct air so as to prevent unwanted gas flow through the opening 4 can be used as the gas seal nozzles 8 and 9, preferably the gas seal nozzles 8 are conventional air knives capable of delivering air at a velocity of from about 6000 to about 8500 feet per minute, and preferably the gas seal nozzles 9 are conventional air foils capable of delivering air at a velocity of about 1000 to about 4500 feet per minute, both commercially available from W. R. Grace & Co.-Conn. The dryer side gas seal nozzles 8 force dryer atmosphere air counter to the direction of travel of the strip of material 1, and the conditioning zone side gas seal nozzles 9 force conditioning zone atmosphere air counter to the direction of travel of the strip of material 1. The pair of opposing gas seal nozzles, air knives 8 and gas seals 9, are sealed to the conditioning zone insulated wall 7 with gasket seals 20 as shown, such that any differential pressure that may exist from the dryer enclosure 6 atmosphere to the conditioning zone 3 atmosphere will not cause an unwanted flow of gases through the opening 4. This gas seal arrangement is especially important in preventing solvent vapors from entering the conditioning zone 3 from the dryer 6 through opening 4. Specifically, the control and prevention of unwanted gas flow through the opening 4 is achieved by the directionality of the air jets of the gas seal nozzles 8, 9. The air knives 8 produce a very distinct, high velocity, high mass flow discharge of gas in a direction counter to the direction of travel of the strip of material 1, and thus cause a bulk movement of dryer atmosphere air away from the opening 4 and the conditioning zone enclosure 3. This constitutes a major portion of the sealing against flows due to possible differential pressure states and/or discharges from adjoining jet nozzles 2. To further reduce the flow of solvent vapors into the conditioning zone enclosure, gas seal nozzles 9 produce a discharge of relatively clean air, as is controlled within the conditioning zone enclosure 3, and again, in a direction counter to the direction of travel of the strip of material 1. This clean air discharge has a low solvent vapor pressure and thus readily mixes with the thermal boundary layer of air on the surface of the strip of material 1, which is of relativly high solvent vapor pressure. The counter flow of this mixture effectively scrubs solvent vapors from the strip of material, preventing entrance to the conditioning enclosure 3 by way of induced flow in the opposite direction into the dryer enclosure 6.

An important feature of the present invention is pressure control in the conditioning zone 3. Through extensive experience, it has been determined that a negative gauge pressure within a dryer enclosure, having similar inlet and outlet apertures, maintained in a range of −0.25 mbar to −1.25 mbar, will adequately prevent solvent vapors from escaping to the surrounding atmosphere. The actual gauge pressure controlled within an enclosure is approximately inversely proportional to the temperature of the controlled atmosphere within the particular enclosure. Additionally, and per design, the mass averaged temperature of the atmosphere within the conditioning enclosure 3 is controlled to 80° C.–105° C. in order to adequately absorb solvent vapors that may be present. The set temperature is direclty related to the dew point temperature corresponding to the solvent vapor saturation pressure.

Air temperature requirements within the dryer enclosure, for purposes of drying, are typically 160° C.–260 C. Thus, significant energy expenditure is required to heat up the make-up air that is necessary as a result of the exhaust from the system. A particular rate of exhaust is provided to maintain a predetermined level of solvent concentration within the dryer. Thus, energy requirements of the system may be reduced if energy can be recovered from the system discharge and used to pre-heat the make-up air. The ability to control the temperature of the pre-heated make-up air assures that over-temperatures will not occur within the dryer.

The pressure control can be accomplished with a supply fan 10 positioned in the conditioning zone 3 to draw ambient air from outside the enclosure 3 via a duct 11 and through a control valve or damper 12. The valve 12 position is controlled from a pressure sensing device 13 in order to maintain a constant, operator set, static pressure within the conditioning zone enclosure 3. preferably a constant negative static gauge pressure within the conditioning zone enclosure 3 is maintained so that any vapors that may exist do not escape to the surroundings through the exit opening 5. The negative static gauge pressure is produced as air is drawn from the conditioning zone enclosure 3 via a duct 14. This air is used as make-up air in the dryer enclosure 6.

Figure 2:
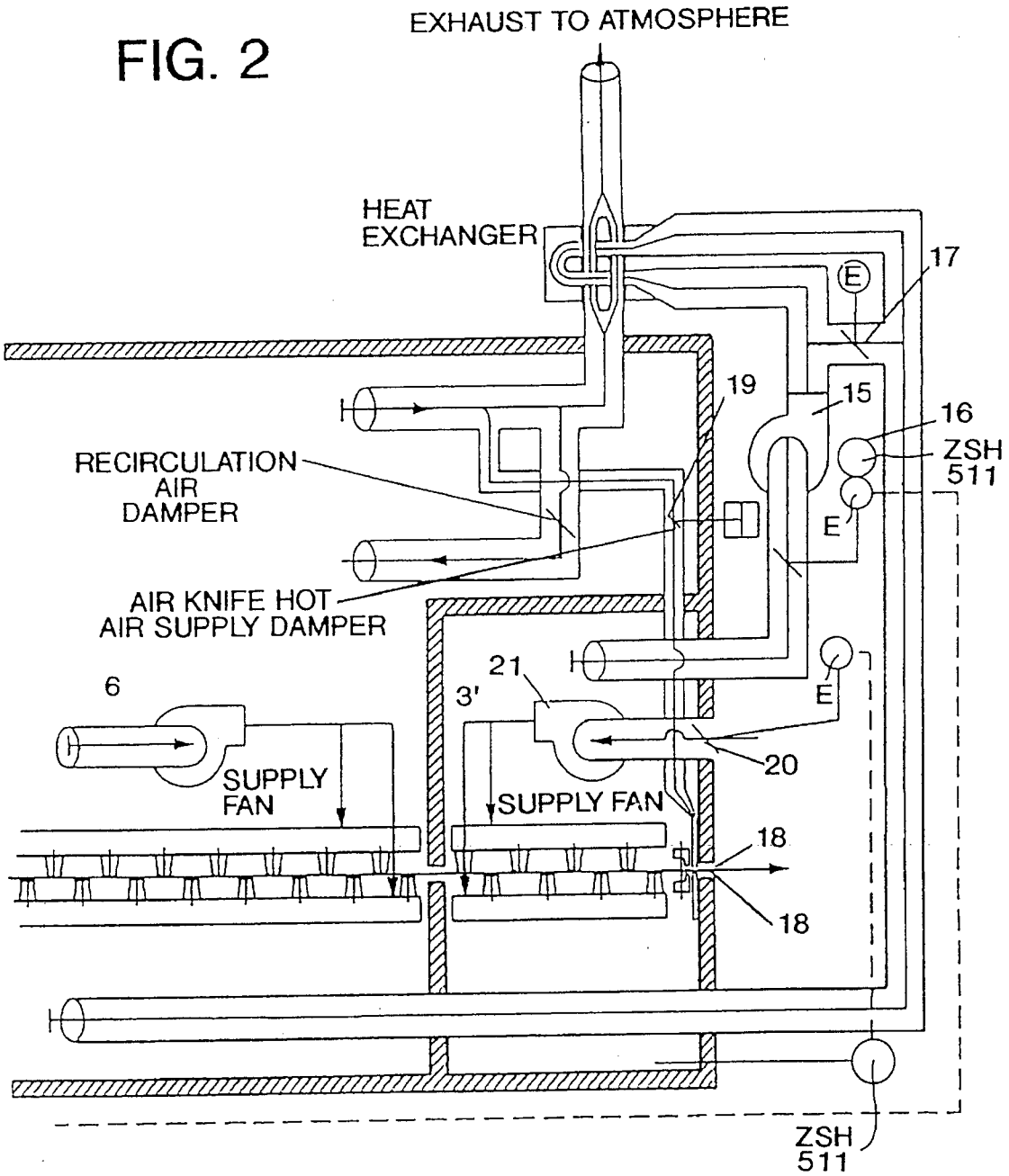
FIG. 2 is a schematic view of a conditioning zone for a dryer in accordance with an alternative embodiment of the present invention.

An alternative embodiment of this pressure control system is illustrated in FIG. 2. Air is drawn out of the conditioning zone enclosure 3' via a make-up air blower 15. The amount of air drawn is controlled by a make-up air damper 16, which is continually manipulated to control a set pressure in the dryer enclosure 6. The air extracted by the make-up air blower 15 may be pushed through a heat exchanger 21, where it is heated prior to entering the dryer enclosure 6 as make-up air. In order to regulate the temperature of this make-up air, a by-pass valve 17 is provided, which controls the temperature of the make-up air entering the dryer enclosure 6 according to energy requirements of the dryer. A conditioning zone make-up air damper 22 and supply fan 23 are associated with make-up air damper 16 to directly control the pressure in the conditioning zone 3'.

Since the air that is drawn into the conditioning zone 3 or 3' is relatively cool ambient air, and since this air is directly discharged onto the strip of material 1 via the air jets 2 in the conditioning zone 3 or 3', the hot strip of material 1 is cooled. The heat from the strip of material 1 is absorbed by the discharged air and is drawn out of the conditioning zone 3 via duct 14 into the dryer enclosure 6, or in the conditioning zone 3' of the alternative embodiment shown in FIG. 2, via make-up air fan 15. In addition, as the ambient surrounding air drawn into the conditioning zone via supply fan 10 is nearly free of solvent vapor, thereby providing an atmosphere within the conditioning enclosure low in solvent vapor pressure and having a low dew point temperature corresponding to the evaporated solvent vapors, condensation of liquid solvent that may occur when temperatures are less than local saturation temperatures, dew point, will be greatly reduced or eliminated. The clean ambient air that is continuously recirculated in the conditioning zone enclosure also maintains the surfaces within the enclosure free of solvent condensation.

Figure 4:
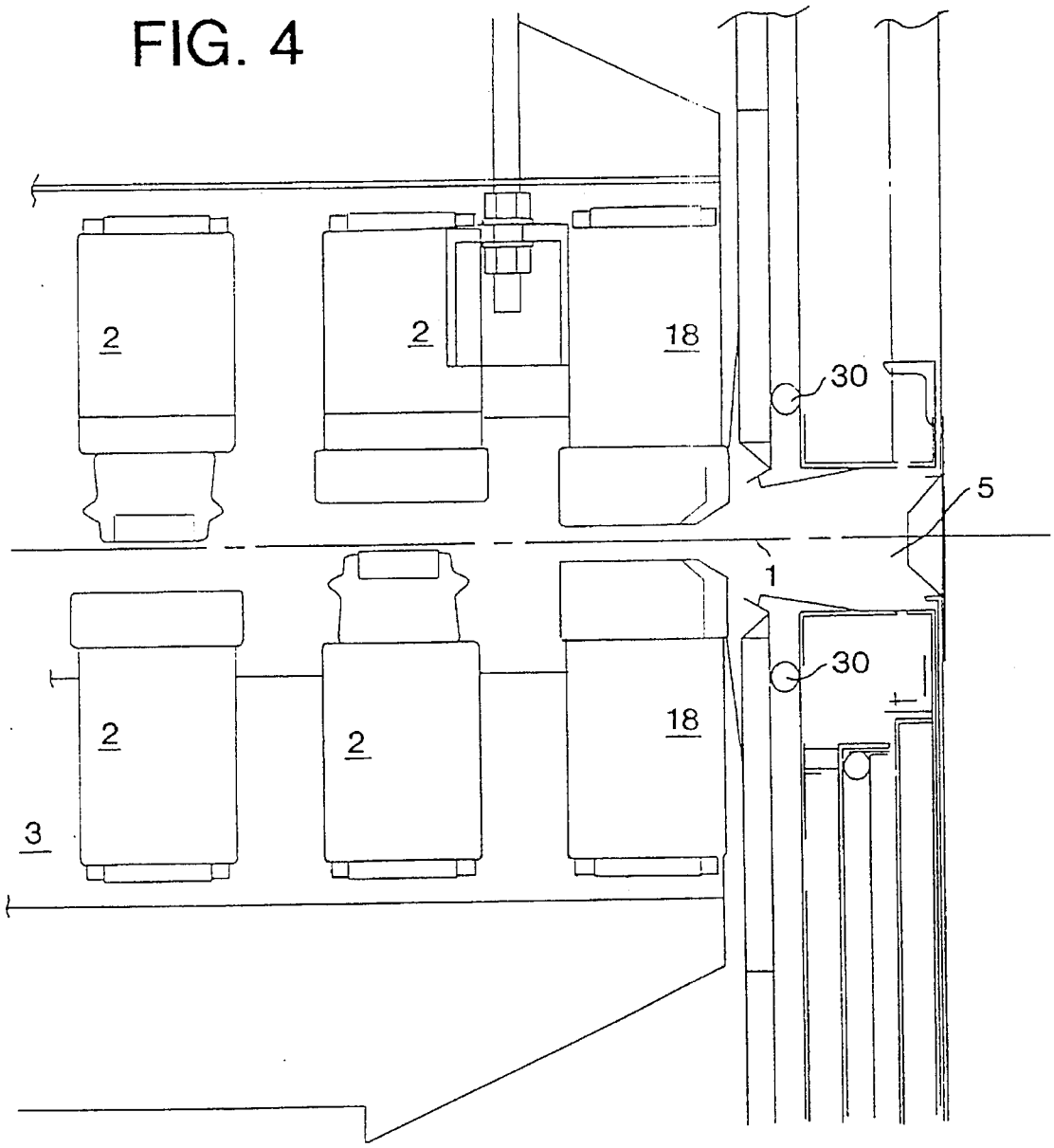
FIG. 4 is an enlarged view showing the gas seal nozzles at the exit of the conditioning zone in accordance with the present invention.

In order to further control and prevent solvent condensation within the conditioning zone enclosure, a heat gas seal 18 (FIG. 4) may be provided just prior to the exit end opening 5. Any suitable nozzles can be used to provide the thermal gas seal, as long as they fulfill the requirement of providing an even, low velocity discharge of hot air into the cold air stream flow that enters the enclosure as infiltration air through exit end opening 5. The discharge velocity of the thermal gas seal nozzles is from about 0 to about 6000 feet per minute, depending upon temperature requirements. The nozzles are mechanically sealed to the conditioning zone exit wall using suitable gaskets 30. Hot air provided to this gas seal 18 is controlled via a gas seal damper 19. The hot air from this gas seal is free of solvent vapors and provides temperature control of the atmosphere within the conditioning zone 3. Hot air expelled from the gas seal 18 is directed into the conditioning zone enclosure 3 interior and mixes with cold ambient air that enters the exit end opening 5 as infiltration air, thus heating the infiltration air and, upon mixing with enclosure 3 atmosphere, raising the average air temperature throughout the conditioning zone enclosure 3. A higher air temperature allows for more vapor to be absorbed, thereby reducing the likelihood of condensation. In this way, the operator of the equipment can strike an optimal balance between providing cooling air for cooling the web, and adding just enough heat to prevent condensation from forming.

What is claimed is:

1. Apparatus for cooling a web of material exiting a dryer enclosure, comprising:

a conditioning zone enclosure located adjacent to said dryer enclosure, said conditioning zone having a web inlet side and a web exit side spaced from said web inlet side, said web inlet side having a web inlet opening, and said web outlet side having a web outlet opening;

a plurality of air jet nozzles in said conditioning zone for blowing air onto said web;

pressure sensing means in said conditioning zone for sensing pressure therein; and means responsive to said pressure sensing means for controlling the pressure in said conditioning zone by regulating the amount of ambient air entering said conditioning zone.

2. The apparatus of claim 1, further comprising conditioning zone side opposed gas seal nozzles positioned in said conditioning zone adjacent to said web inlet opening, said conditioning zone side opposed gas seal nozzles being sealed to said web inlet side of said conditioning zone, said conditioning zone side opposed gas seal nozzles blowing air in said conditioning zone in a direction counter to the direction of travel of said web.

3. The apparatus of claim 2, wherein said dryer enclosure is separated from said conditioning zone enclosure by a wall in which said web inlet opening is formed, said web inlet opening having a dryer enclosure side and a conditioning zone enclosure side, said apparatus further comprising dryer side opposed gas seal nozzles positioned in said dryer enclosure adjacent to said web inlet opening, said dryer side opposed gas seal nozzles being sealed to said dryer enclosure side of said web inlet opening, said dryer side opposed gas seal nozzles blowing air in said dryer in a direction counter to the direction of travel of said web.

4. The apparatus of claim 1, wherein said means responsive to said pressure sensing means comprises a control valve positioned in a duct in air receiving communication with said ambient air.

5. The apparatus of claim 4, wherein said means responsive to said pressure sensing means further comprises a fan in communication with said duct.

6. Apparatus for cooling a web of material exiting a dryer enclosure, comprising:

a conditioning zone enclosure located adjacent to said dryer enclosure, said conditioning zone having a web inlet side and a web exit side spaced from said web inlet side, said web inlet side having a web inlet opening, and said web outlet side having a web outlet opening;

a plurality of air jet nozzles in said conditioning zone for blowing air onto said web;

pressure sensing means in said dryer enclosure for sensing pressure therein; and means responsive to said pressure sensing means for controlling the pressure in said conditioning zone by regulating the amount of ambient air entering said conditioning zone.

7. The apparatus of claim 6, further comprising conditioning zone side opposed gas seal nozzles positioned in said conditioning zone adjacent to said web inlet opening, said conditioning zone side opposed gas seal nozzles being sealed to said web inlet side of said conditioning zone, said conditioning zone side opposed gas seal nozzles blowing air in said conditioning zone in a direction counter to the direction of travel of said web.

8. The apparatus of claim 7, wherein said dryer enclosure is separated from said conditioning zone enclosure by a wall in which said web inlet opening is formed, said web inlet opening having a dryer enclosure side and a conditioning zone enclosure side, said apparatus further comprising dryer side opposed gas seal nozzles positioned in said dryer enclosure adjacent to said web inlet opening, said dryer side opposed gas seal nozzles being sealed to said dryer enclosure side of said web inlet opening, said dryer side opposed gas seal nozzles blowing air in said dryer in a direction counter to the direction of travel of said web.

* * * * *